US007192271B2

(12) United States Patent
Dreyer et al.

(10) Patent No.: US 7,192,271 B2
(45) Date of Patent: Mar. 20, 2007

(54) METHOD AND COOLING DEVICE FOR THE SUBRACKS IN A CHAMBER FURNACE

(75) Inventors: Christian Dreyer, St. Jean de Maurienne (FR); Nigel Backhouse, St. Jean de Maurienne (FR)

(73) Assignee: Aluminium Pechiney, Paris Cedex (FR)

( * ) Notice: Subject to any disclaimer, the term of this patent is extended or adjusted under 35 U.S.C. 154(b) by 0 days.

(21) Appl. No.: 10/476,488

(22) PCT Filed: May 28, 2002

(86) PCT No.: PCT/FR02/01785

§ 371 (c)(1),
(2), (4) Date: Feb. 19, 2004

(87) PCT Pub. No.: WO02/097349

PCT Pub. Date: Dec. 5, 2002

(65) Prior Publication Data

US 2004/0137396 A1 Jul. 15, 2004

(30) Foreign Application Priority Data

May 30, 2001 (FR) ..... 01 07083

(51) Int. Cl.
*F27B 7/06* (2006.01)

(52) U.S. Cl. ..... 432/192

(58) Field of Classification Search ..... 432/19, 432/192, 194, 247, 249, 209, 4, 10, 189, 432/193, 224, 82, 83
See application file for complete search history.

(56) References Cited

U.S. PATENT DOCUMENTS 1,829,334 A * 10/1931 Birtch ..... 122/19.1
2,561,424 A * 7/1951 Spieth ..... 165/71
4,215,982 A * 8/1980 Genevois et al. ..... 432/192
4,744,749 A * 5/1988 Dreyer et al. ..... 432/121
4,859,175 A * 8/1989 Dreyer et al. ..... 432/4
4,889,182 A * 12/1989 Kosters ..... 165/134.1
5,069,169 A * 12/1991 Maruko ..... 122/33
5,759,027 A * 6/1998 Werge-Olsen et al. ..... 432/192
6,027,339 A * 2/2000 Dreyer et al. ..... 432/192
6,339,729 B1 * 1/2002 Dreyer et al. ..... 700/209

FOREIGN PATENT DOCUMENTS

| | | |
|---|---|---|
| BE | 565015 | 2/1958 |
| DE | 29614948 | 1/1998 |
| FR | 628332 | 10/1927 |
| GB | 1533588 | 11/1978 |
| GB | 2021742 | 12/1979 |
| SU | 388188 | 6/1973 |
| SU | 840653 | 6/1981 |
| SU | 881127 | 11/1981 |

* cited by examiner

*Primary Examiner*—Gregory Wilson
(74) *Attorney, Agent, or Firm*—Dennison, Schultz & MacDonald

(57) ABSTRACT

The invention relates to a ring furnace pit (2) cooling method, comprising the production of a flux F of cooling fluid inside the pit (2) and the flow of at least a part Fr of said flux F in a roughly vertical manner along determined surfaces of the walls (2A, 2B) of the pit (2). The invention also relates to a device capable of implementing the method.

The invention makes it possible to accelerate the cooling rate of ring furnace pits considerably.

20 Claims, 5 Drawing Sheets

METHOD AND COOLING DEVICE FOR THE SUBRACKS IN A CHAMBER FURNACE

This application is a filing under 35 USC 371 of PCT/FR02/01785, filed May 28, 2002.

FIELD OF THE INVENTION

The invention relates to the field of so-called "ring furnaces" for firing carbonaceous blocks, and particularly open type chamber furnaces. The invention relates more specifically to a method and a device to cool the pits of such furnaces before servicing and maintenance operations.

STATE OF THE ART

Open type ring furnaces are well known themselves and are particularly disclosed in the French patent applications FR 2 600 152 (corresponding to the American patent U.S. Pat. No. 4,859,175) and FR 2 535 834 (corresponding to the British application GB 2 129 918).

A ring furnace comprises a succession of aligned chambers, each chamber comprising a plurality of elongated pits separated by hollow heating partitions.

A carbonaceous block firing cycle, for a given chamber, typically comprises the loading of the pits of said chamber with unprocessed carbonaceous blocks, heating of said chamber to the carbonaceous block firing temperature (typically from 1100 to 1200° C.), cooling of the chamber to a temperature enabling the removal of the fired carbonaceous blocks and cooling of the chamber to ambient temperature. The ring furnace principle consists of successively performing the heating cycles on the chambers of the furnace by moving the heating means (such as burner ramps) and the suction means.

In this way, a given chamber passes successively through preheating, firing and cooling periods. Typically, a dozen chambers are "active" at the same time: four in a so-called cooling zone, three in a so-called heating zone, and three in a so-called preheating zone. The active chambers form what is referred to as a "fire".

However, the pit cooling times after the removal of the carbonaceous blocks, which are very long, limit the productivity of the furnaces when actions are required on the furnace, particularly the replacement of partitions, since it is not possible, for health reasons, to have operators work inside the pits before the temperature of the walls is less than approximately 30° C., which requires waiting periods generally greater than 3 days.

Therefore, the applicant researched simple means that could be industrialised to accelerate pit cooling.

DESCRIPTION OF THE INVENTION

The invention relates to a ring furnace pit cooling method characterised in that it comprises the production of a flux F of cooling fluid inside the pit and in that at least a part Fr of said flux F flows in a roughly vertical manner along determined surfaces of the walls of the pit.

The invention also relates to a ring furnace pit cooling device characterised in that it comprises:

- at least one first means capable of producing a flux F of cooling fluid inside the pit, such as a ventilation means;
- at least one second means capable of inducing a roughly vertical flow of at least a part Fr of said flux F along determined surfaces of the walls of the pit, such as a confinement means.

The invention also relates to a ring furnace pit cooling method using the device according to the invention.

The applicant observed that the roughly vertical flow of the cooling fluid flux in the vicinity of the pit walls made it possible to accelerate the cooling rate of said pit considerably. In this way, the invention may make it possible, in certain cases, to remove one chamber per fire in an industrial scale furnace.

The invention will be understood more clearly using the figures and detailed description below.

Figure 1:
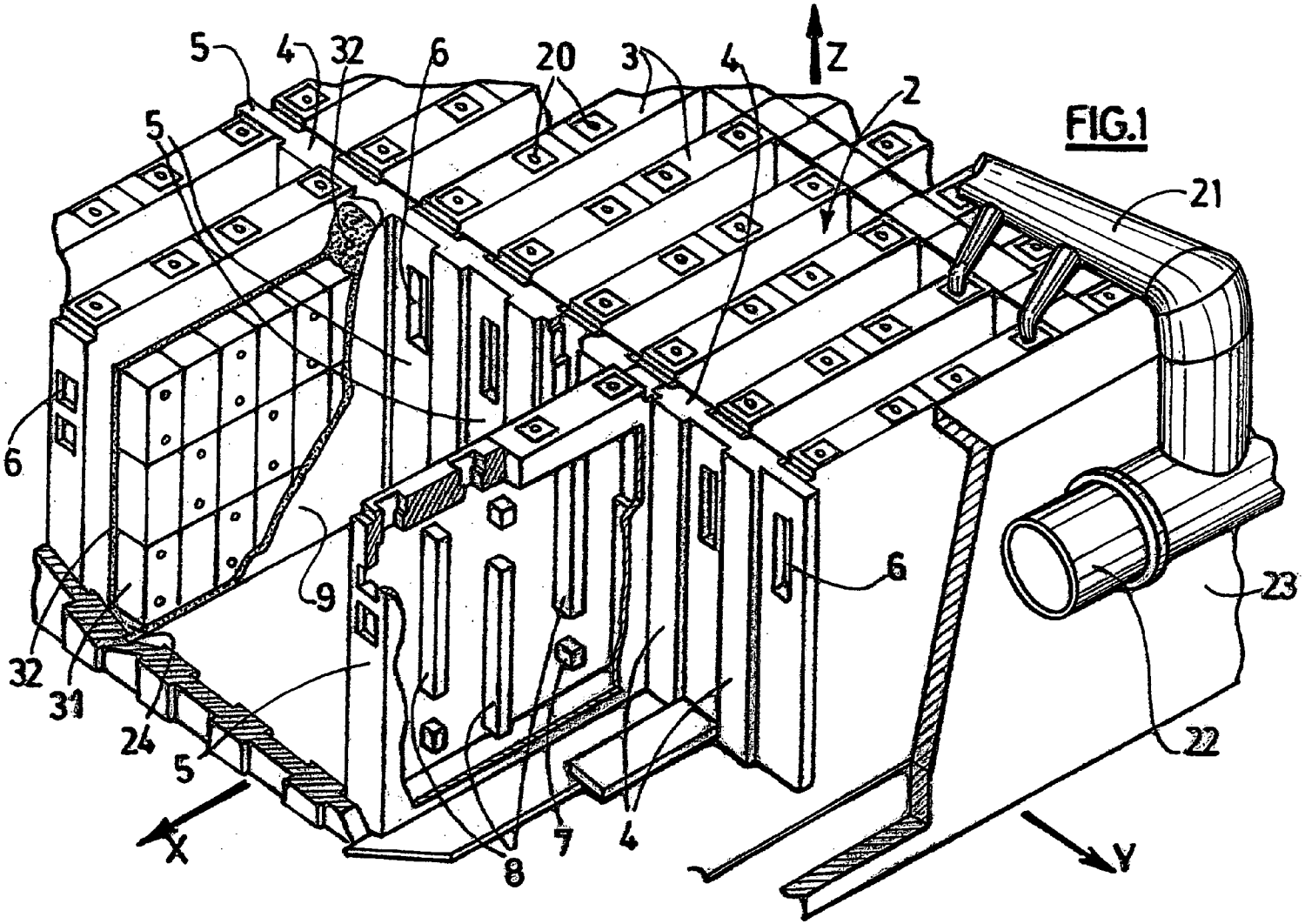
FIG. 1 illustrates a partially exploded perspective view of a ring furnace.
Figure 2:
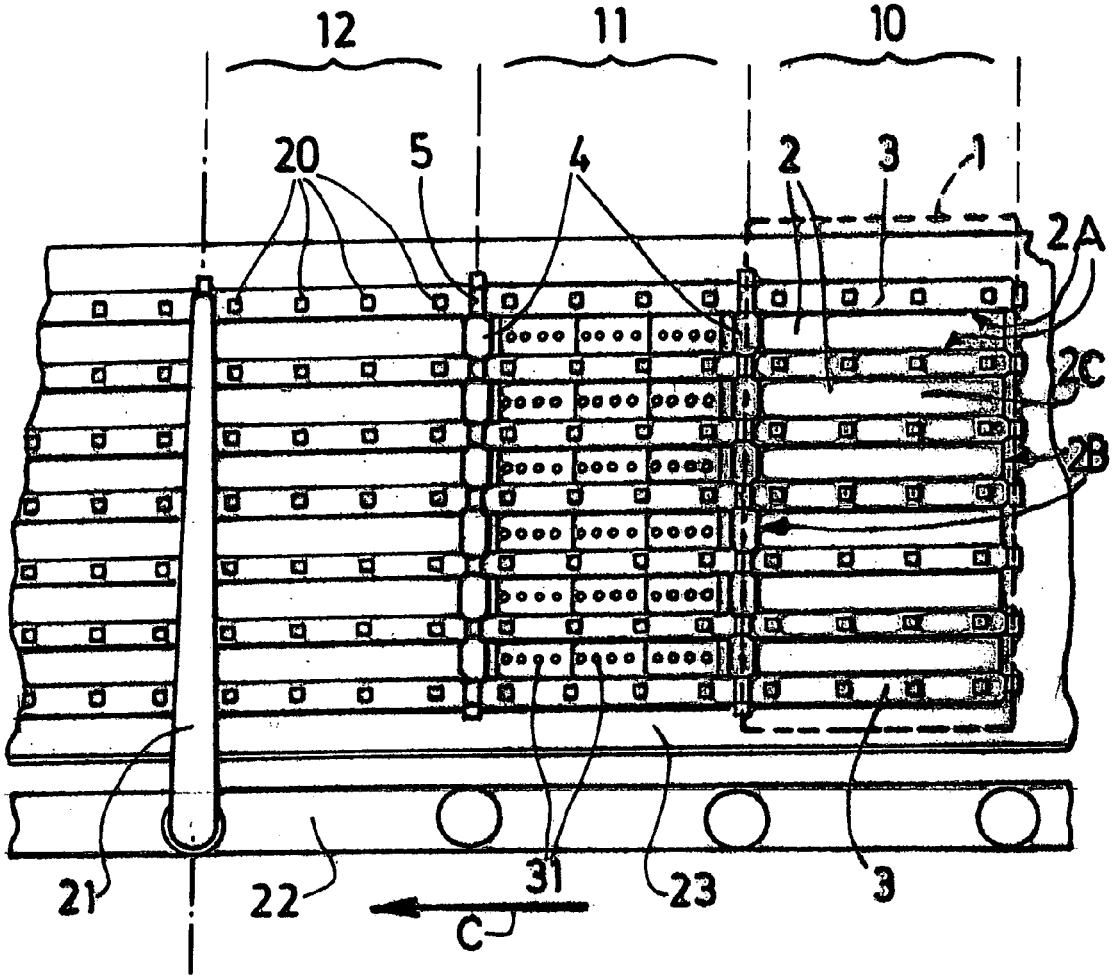
FIG. 2 illustrates a top view (Z axis) of a ring furnace section.

As illustrated in FIGS. 1 and 2, a ring furnace comprises a succession of chambers 10, 11, 12, etc. arranged in series. Each chamber comprises an alternation, in the transversal direction (Y axis), of elongated pits 2 and hollow heating partitions 3 arranged in the longitudinal direction (X axis). As an illustration, the dotted line 1 in FIG. 1 delimits one of the chambers and shows that it comprises several pits 2 arranged in parallel and separated by partitions 3.

The pits 2 are delimited by heating partitions 3, transversal wall pillars 4 and a floor 24. The heating partitions 3 and the transversal wall pillars 4 form roughly vertical walls 2A, 2B; the floor 24 forms a roughly horizontal base 2C. The ends of the heating partitions 3 generally comprise transversal walls 5 equipped with openings 6. The heating partitions 3 comprise thin lateral walls 9 generally separated by struts 7 and baffles 8. The heating partitions 3 are equipped with access means 20 referred to as "peepholes" which are particularly used to introduce heating means (such as burner injectors) (not shown) or suction means 21, 22. The components 2, 3, 4, 5, 24 of the furnace are formed of heat-resistant materials, typically using refractory bricks. Each pit 2 is typically 5 m deep.

FIG. 1 shows a typical stack of carbonaceous blocks 31 in a pit 2, with a coating powder 32, during a firing operation of said blocks.

The chambers form a long section in the C direction of the fire. A ring furnace typically comprises two parallel sections, each being of the order of one hundred metres long. The sections are generally delimited by sidewalls 23.

During the firing operations, a gaseous flow composed of air, heating gas, vapours released by the carbonaceous blocks or combustion gas (or most frequently a mixture of said substances) circulates, along the furnace (X axis), in a succession of hollow heating partitions 3 which communicate with each other. This gaseous flow is blown upstream from the active chambers and aspirated downstream from said chambers. The heat produced by the combustion of the gases is transmitted to the carbonaceous blocks 31 contained in the pit 2, inducing their firing.

DETAILED DESCRIPTION OF THE INVENTION

According to the invention, the ring method of cooling a pit 2 of a ring furnace, said pit 2 comprising walls 2A, 2B, is characterised in that it comprises the production of a flux F of cooling fluid inside the pit 2 and in that at least a part Fr of said flux F flows in a roughly vertical manner along determined surfaces of the walls 2A, 2B of the pit 2.

The inside of the pit corresponds to the space normally occupied by carbonaceous blocks 31 and the coating powder or "packing material" 32 during firing.

A roughly vertical flow refers to a flow for which the vertical components of the flux F of gas is considerably greater than the horizontal components (typically approximately ten times greater), so as to maximise the flux of thermal energy extracted from the walls and evacuated outside the pit. Said flow is preferentially low in turbulence, and even more preferentially roughly laminar. Said vertical flow may be upward or downward.

Said flux F is typically a forced flux, which is produced for example by blowing or suction of cooling fluid.

Said part Fr of said flux F circulates typically in a so-call "flow" cross-section S in the vicinity of the walls of the pit, with a rapid flow of said cooling fluid in a roughly parallel direction to said walls. The flux Fr preferentially circulates in a restricted volume V, in the vicinity of said walls, which makes it possible to obtain an effective evacuation of the heat from the walls for acceptable fluid flow rates (typically between 1 and 10 $Nm^3/s$).

Figure 6:
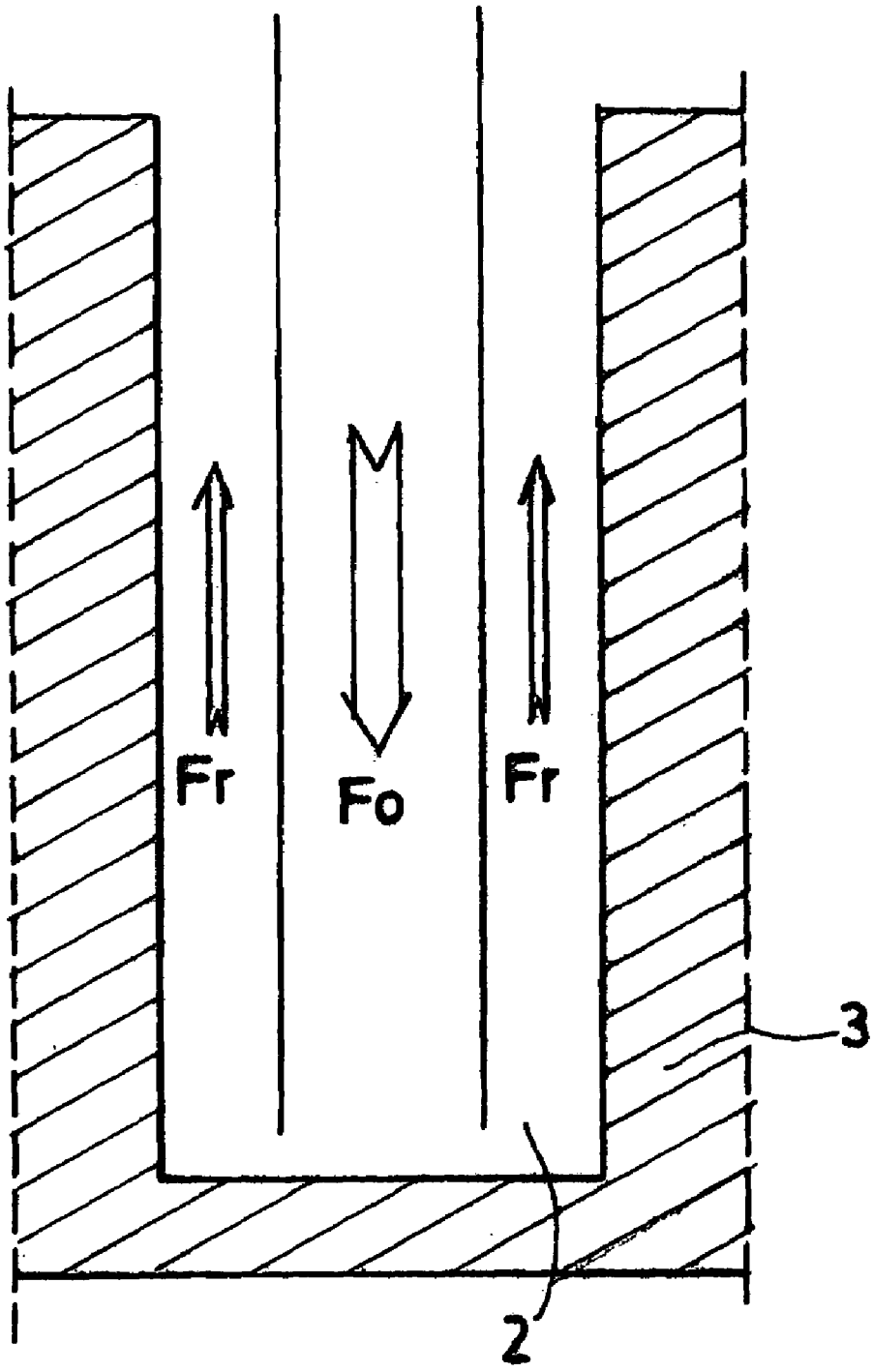

Said flux F typically comprises two main components, i.e. said part Fr, which "licks" the walls of the pit, and a part Fo, which introduces cooling fluid into the pit. In the preferred embodiment of the invention, the fluxes Fr and Fo are roughly parallel and circulate in opposite directions, as illustrated in FIG. 6. The flow rates of Fr and Fo are typically roughly identical.

The cooling fluid is preferentially a gas, or a mixture of gases. It is advantageous to use air to limit operating costs, i.e. said fluid contains air. The cooling fluid is advantageously humid, i.e. it contains water (typically in the form of vapour or fine droplets), so as to increase its specific heat capacity. The moisture level of the fluid may be adjusted, for example as a function of the pit wall temperature. In a preferred alternative embodiment of the invention, said fluid comprises a mixture of air and moisture. Typically, the fluid which is injected in the pit is air at ambient temperature with varying moisture content.

The cooling fluid flux may be in an open circuit, in that it is evacuated in the ambient atmosphere after having absorbed part of the heat from the walls of a pit during its flow inside said pit.

According to the invention, the device 100 for cooling a pit 2 of a ring furnace, said pit 2 comprising walls 2A, 2B and a base 2C, is characterised in that it comprises:

- at least one first means 101 capable of producing a flux F of cooling fluid inside the pit 2;
- at least one second means 103 capable of inducing a roughly vertical flow of at least a part Fr of said flux F along determined surfaces of the walls 2A, 2B of the pit 2.

Said first means 101 is typically a ventilation means, such as a suction or a blowing means.

Said second means 103 is advantageously a so-called "confinement" means, capable of reducing the flow cross-section S of said flux F in the vicinity of the pit walls, so as to induce a rapid flow of said fluid in a roughly parallel direction to said walls. The flux F circulates in this case in a restricted volume V in the vicinity of said walls.

The flow cross-section S is approximately equal to L×P, where L is the confinement width and P is the average inner perimeter of the pit. The width L is preferentially between 5 cm and 25 cm, and more preferentially between 10 cm and 20 cm. An insufficient width results in significant pressure drops. An excessive width results in an insufficient flow velocity, and, as a result, an insufficient cooling rate.

Preferentially, the confinement of said flux F also induces an increase in the flow velocity Ve of said fluid. The flow velocity of the cooling fluid in said part Fr of said flux F is advantageously between 2 and 20 m/s. An insufficient velocity does not make it possible to reduce the cooling time of a pit in a beneficial manner. A very high flow velocity requires costly ventilation means and a high-energy consumption. The fluid flow rate of said flux is typically between 1 and 10 $Nm^3/s$ for industrial furnaces.

The confinement means 103 is typically a duck, such as a rigid or flexible duck or a flexible tube, wherein a first end is joined to said (or to each said) ventilation means 101 and wherein a second end 104 may be placed inside the pit 2. In this case, the cooling fluid, which is moved using the ventilation means 101, is guided by the duck and injected into the pit (or aspirated from said pit) by at least one opening located at said second end 104. The duck restricts the flow surface S of said flux by forcing said flux to flow between the surface of said duck and said walls 2A, 2B.

The confinement means 103 are advantageously removable and/or retractable, so as to facilitate the positioning of the device. For example, the confinement means 103 may be a detachable rigid duck (i.e. a duck which can be detached from the device 100) which may be positioned in the pit and then connected to the ventilation means 101 of said device.

The confinement means 103 may be connected to the ventilation means 101 using connection means 102.

Figure 3:
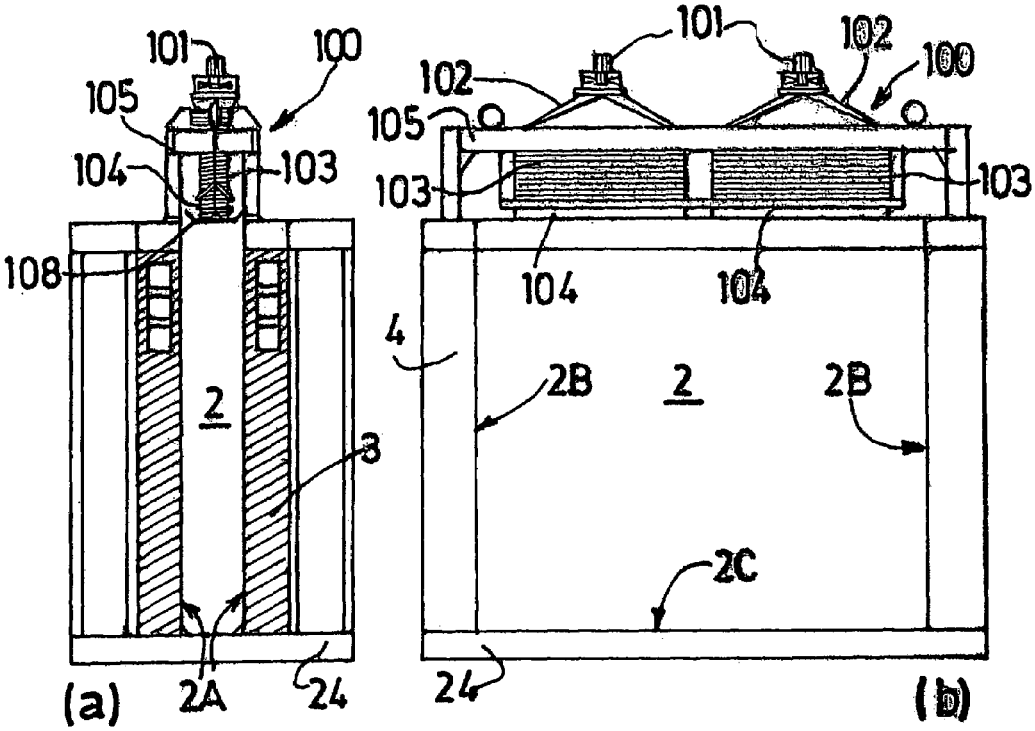
FIG. 3 illustrates an embodiment of the device according to the invention, in the standby position, (a) viewed on the narrow side (X axis) and (b) viewed from the wide side (Y axis).
Figure 4:
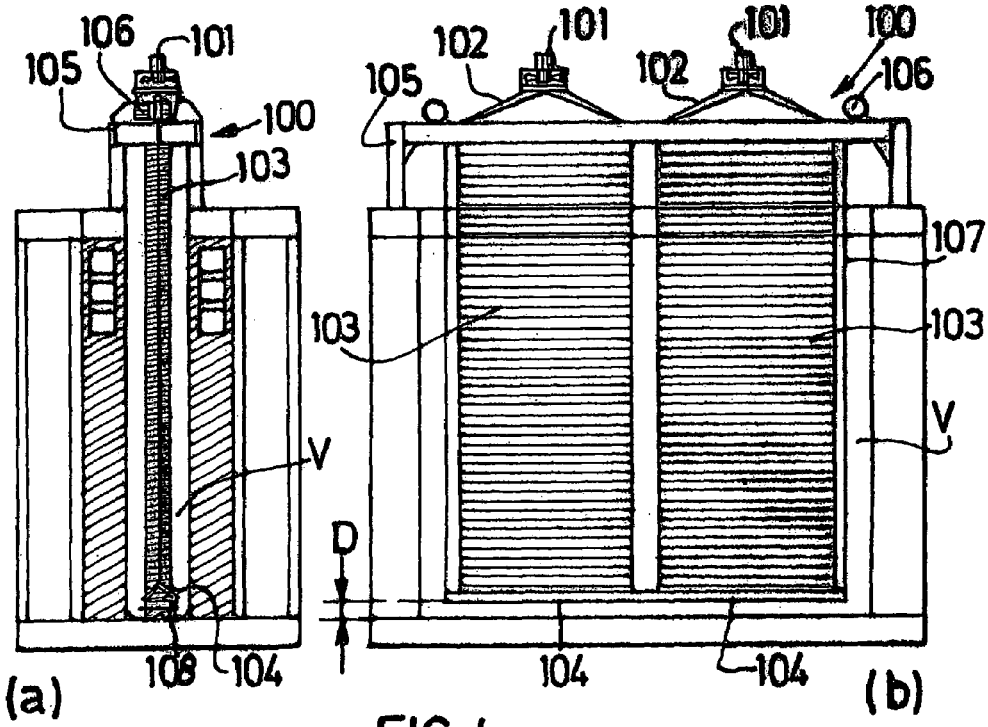
FIG. 4 illustrates an embodiment of the device according to the invention, in the extended position, (a) viewed on the narrow side (X axis) and (b) viewed from the wide side (Y axis).
Figure 5:
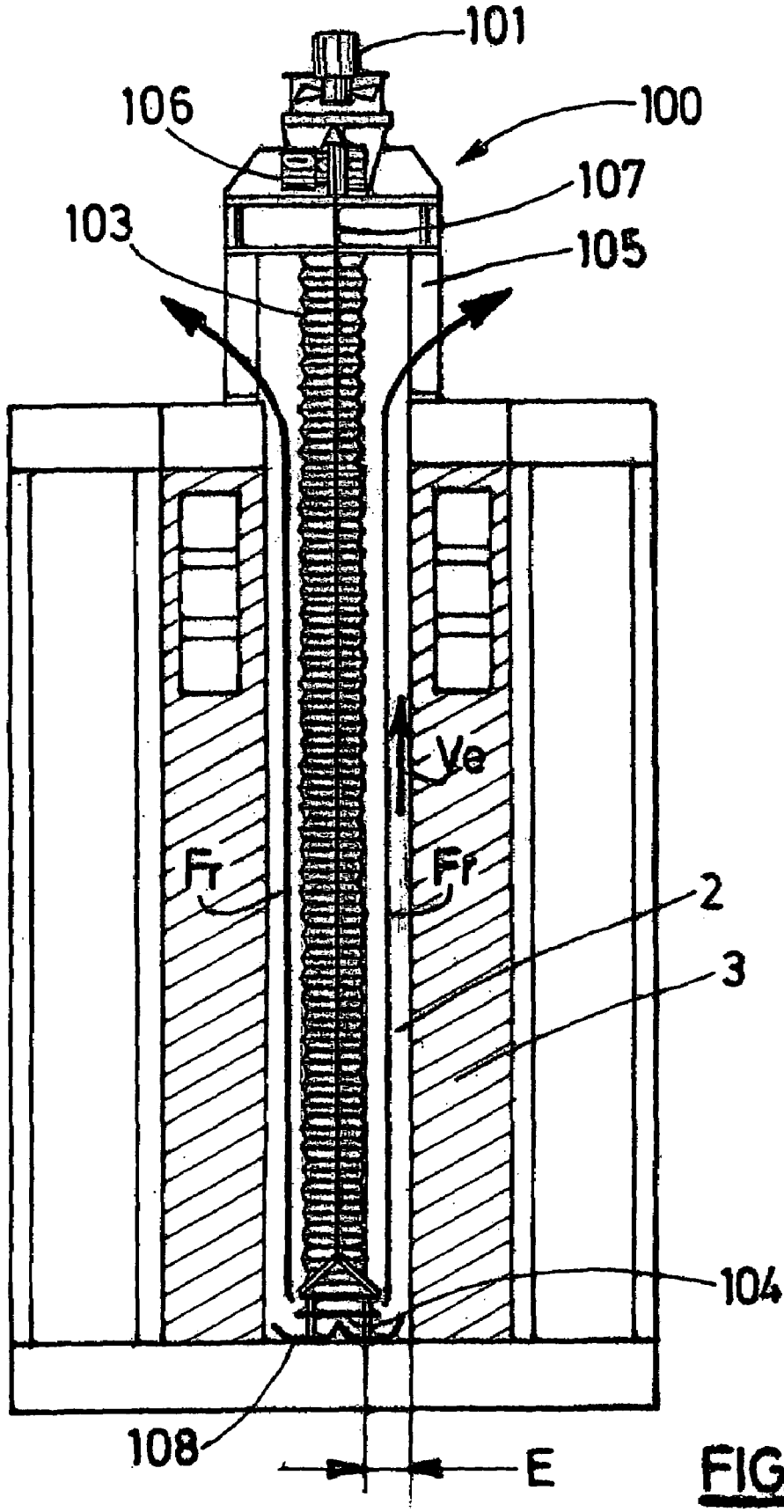
FIGS. 5 and 6 illustrate the movement of cooling fluid flux obtained with the preferred embodiment of the device according to the invention.

In a preferred embodiment of the invention, the confinement means 103 are a retractable tubular duct having at least one retracted position (as illustrated in FIG. 3) and at least one extended position (as illustrated in FIG. 4). The length of said duct may be variable or adjustable. This embodiment offers the advantage of enabling easy positioning of the device.

As illustrated in FIGS. 3 and 4, the retractable tubular duct may be in the form of bellows (typically if the cross-section is roughly circular or oval) or an accordion (typically if the cross-section is roughly rectangular or square), which facilitates its extension. Said duct may also have other structures, such as a telescopic structure formed of several sections of duct inserted into each other in a sliding manner. The duct 103 may be retracted or extended using extension means 106, 107, such as a motor and cables.

The duct 103 is preferentially such that it can be extended up to a small distance D from the base 2C of the pit, said distance D being preferentially less than around 50 cm. The distance D is typically of the order of 20 cm.

The dimensions of the duct are preferentially such that the average distance E between said duct and the walls of the pit is between 5 and 25 cm, and more preferentially between 10 and 20 cm. An insufficient distance results in significant pressure drops which may be detrimental. An excessive distance results in an insufficient flow velocity and, as a result, an insufficient cooling rate. A distance of approximately 15 cm was found to be very satisfactory.

In an alternative embodiment of the invention, said first means (which are typically ventilation means) may produce a downward flow in the or each said duct and an upward vertical flow along said walls 2A, 2B of the pit 2. In another alternative embodiment of the invention, said first means may produce an upward flow in the or each said duct and a downward vertical flow along said walls 2A, 2B of the pit 2.

The ventilation means 101 are blowing means, such as a fan, when trying to create an upward flow along the walls 2A, 2B and suction means when trying to create a downward flow along walls 2A, 2B.

Preferentially, when said vertical flow is upward along walls 2A, 2B of the pit 2 (and therefore downward in the duct (s)), the so-called "open" end 104 of the (or each) duct 103 may be equipped with a diffuser 108 capable of favouring an upward deflection of the fluid flux from the duct via said end. The diffuser is advantageously such that it reduces pressure drops at the so-called open end 104 of the (or each) duct 103.

The duct is preferentially composed of a flexible, high modulus, material, capable of resisting temperatures less than or equal to approximately 250° C. and the blowing pressure, such as an aromatic polyamide fibre (such as Kevlar®). Said material may be a composite, such as a multilayer composite. Said material is preferentially tight in order in particular to reduce pressure drops along said duct. In this aim, said material may be, for example, a multilayer composite comprising a flexible fabric (such as a Kevlar® fabric) and a tight layer (such as an aluminium layer). The use of a multilayer composite comprising a flexible layer and an aluminium layer (on the outer surface of the duct) also makes it possible to reflect the thermal radiation from the pit walls and thus prevent excessive heating of the underlying flexible layer.

The device according to the invention 100 is preferentially removable. It comprises advantageously support components 105 used to operate it and position it over a pit.

The device according to the invention is capable of implementing the cooling method according to the invention.

The device according to the invention may be used for cooling a pit 2 of a ring furnace, and particularly in a method of cooling a pit 2 of a ring furnace comprising:

positioning the cooling device 100 according to the invention;

producing a flux of cooling fluid within the pit 2.

In particular, the device according to the invention may be used in a method of cooling a pit 2 of a ring furnace comprising:

positioning the cooling device 100 according to the invention;

extending the confinement means 103, particularly inside the pit 2;

producing a flux of cooling fluid using the ventilation means 101.

These operations are normally performed after the removal of the fired carbonaceous blocks and the packing material contained in the pit.

The extension of the duck may follow a predetermined progression or be controlled according to measurable parameters such as the pit wall temperature.

Tests

Cooling tests on a ring furnace pit were conducted with a device according to the invention comparable to that represented in FIGS. 3 and 4. In these tests, the pit was 4.76 m deep and has an inner cross-section of 23.7 $m^2$. The cooling fluid was air with varying moisture content. The air flux velocity was typically from 5 to 10 m/s. The air flow rate was approximately 3 $m^3$/s per fan (and therefore 6 $m^3$/s in total). The average distance E between the pit walls and the duct 103 was approximately 15 cm. The flux was downwards in the ducts and upwards along the pit walls.

The cooling of the pit was measured using thermocouples plugged into its walls. The initial temperature of the base of the pit was of the order of approximately 130 to 200° C., depending on the position in the direction of the fire.

With no cooling device, the time required for the temperature of the base of the pit to fall to 20° C. was typically 40 hours. With the device according to the invention, it was possible to reduce this time to values of the order of 10 hours.

The device according to the invention proved to generate a low noise level.

The invention claimed is:

1. Method of cooling a pit of a ring furnace, said ring furnace comprising walls comprising hollow heating partitions with the pit defined between adjacent walls, comprising producing a flux F of cooling fluid inside the pit, at least a part Fr of said flux F flowing in a substantially vertical direction along determined surfaces of the walls of the pit, wherein said flux F also comprises a part Fo which is roughly parallel to the part Fr and circulated in an opposite direction.

2. Method according to claim 1, wherein said flux F is forced.

3. Method according to claim 2, wherein the forced flux is produced by blowing or suction of said cooling fluid.

4. Method according to claim 1, wherein part Fr of flux F has a flow velocity between 2 and 20 m/s.

5. Method according to claim 1, wherein said flux has a fluid flow rate between 1 and 10 $Nm^3$/s.

6. Method according to claim 1, wherein said vertical flow is upward.

7. Method according to claim 1, wherein said vertical flow is downward.

8. Method according to claim 1, wherein said fluid contains air.

9. Method according to claim 1, wherein said fluid contains water.

10. Device for cooling a pit of a ring furnace, said pit comprising walls and a base, comprising:

at least one first means for producing a flux F of cooling fluid inside the pit; and at least one second means for inducing a substantially vertical flow of at least a part Fr of said flux F along determined surfaces of the walls of the pit, wherein said second means is a confinement means, constructed and arranged to reduce a flow cross-section S of the flux F in the vicinity of the pit walls, so as to induce a rapid flow of said fluid in a direction substantially parallel to said walls, and wherein said first means is a ventilation means, wherein said confinement means is a duct, and wherein a first end is joined to, or to each, said ventilation means, and wherein a second end is disposable inside the pit.

11. Device according to claim 10, wherein said confinement means is removable.

12. Device according to claim 10, wherein said confinement means is retractable.

13. Device according to claim 12, additionally comprising extension means for extending or retracting said confinement means.

14. Device according to claim 10, wherein said duct is in the form of bellows or an accordion.

15. Device according to claim 10, wherein said duct has dimensions such that an average distance E between said duct and the walls of the pit is between 5 and 25 cm.

16. Device according to claim 10, wherein said first means is constructed and arranged to produce a downward flux in the or each duct and an upward vertical flux along said walls of the pit.

17. Device according to claim 16, wherein said second end is equipped with a diffuser constructed and arranged to favor an upward deflection of the fluid flux from the duct via the second end.

18. Device according to claim 10, wherein said first means is constructed and arranged to produce an upward flow in the or each duct and a downward vertical flow along said walls of the pit.

19. Device according to claim 10, wherein the or each duct is extendable up to a distance D from the base of the pit less than approximately 50 cm.

20. Method of cooling a pit of a ring furnace comprising: positioning a cooling device according to claim 10; and producing a flux of cooling fluid within the pit.

* * * * *

UNITED STATES PATENT AND TRADEMARK OFFICE

CERTIFICATE OF CORRECTION

PATENT NO. : 7,192,271 B2
APPLICATION NO. : 10/476488
DATED : March 20, 2007
INVENTOR(S) : Christian Dreyer et al.

It is certified that error appears in the above-identified patent and that said Letters Patent is hereby corrected as shown below:

Column 4, line 19, change “duck” to --duct--;
line 20, change “duck” to --duct--;
line 24, change “duck” to --duct--;
line 26, change “duck” to --duct--;
line 28, change “duck” to --duct--;
line 32, both occurrences, change “duck” to --duct--.

Column 5, line 57, change “duck” to --duct--.

Signed and Sealed this

Twenty-second Day of May, 2007

JON W. DUDAS
*Director of the United States Patent and Trademark Office*